US009696104B1

(12) United States Patent
Bloomfield

(10) Patent No.: US 9,696,104 B1
(45) Date of Patent: Jul. 4, 2017

(54) TRIGGER

(71) Applicant: Pressure Break, LLC, Grand Prairie, TX (US)

(72) Inventor: Nicholas Bloomfield, Kirtland, NM (US)

(73) Assignee: PRESSURE BREAK, LLC, Grand Prairie, TX (US)

( * ) Notice: Subject to any disclaimer, the term of this patent is extended or adjusted under 35 U.S.C. 154(b) by 0 days.

(21) Appl. No.: 15/001,030

(22) Filed: Jan. 19, 2016

Related U.S. Application Data

(60) Provisional application No. 62/105,167, filed on Jan. 19, 2015.

(51) Int. Cl.
*F41A 19/10* (2006.01)

(52) U.S. Cl.
CPC ..... *F41A 19/10* (2013.01)

(58) Field of Classification Search
CPC ..... F41A 17/46; F41A 19/00; F41A 19/09; F41A 19/10
USPC ..... 42/69.01, 69.02, 1.01, 70.06; 124/31, 124/35.2; D22/108
See application file for complete search history.

(56) References Cited

U.S. PATENT DOCUMENTS

| | | | |
|---|---|---|---|
| 4,276,868 | A | 7/1981 | Burrows et al. |
| 4,440,064 | A | 4/1984 | Stehlik |
| 4,532,852 | A | 8/1985 | Hance et al. |
| 4,685,379 | A | 8/1987 | Troncoso |
| 4,718,187 | A | 1/1988 | Blake |
| 4,787,288 | A | 11/1988 | Miller |
| 4,803,910 | A | 2/1989 | Troncoso |
| 5,074,190 | A | 12/1991 | Troncoso |
| 5,359,799 | A | 11/1994 | Moon |
| 5,780,762 | A | 7/1998 | Kobayashi |
| 5,852,891 | A | 12/1998 | Onishi et al. |
| 5,954,507 | A | 9/1999 | Rod et al. |
| 6,101,918 | A | 8/2000 | Akins |
| 6,223,644 | B1 | 5/2001 | Troncoso |
| 6,354,032 | B1 | 3/2002 | Viani |
| 6,499,243 | B1 * | 12/2002 | Herzog ..... F41A 17/066 42/70.06 |

(Continued)

OTHER PUBLICATIONS

PPQ M2, Walther—Built for Life.—available as of Oct. 6, 2015, http://www.waltherarms.com/products/ppg-m2/.

(Continued)

*Primary Examiner* — Jonathan C Weber
(74) *Attorney, Agent, or Firm* — Knobbe, Martens, Olson & Bear LLP

(57) ABSTRACT

A trigger can include one or more kinesthetic features to provide increased mechanoreceptor stimulation. This can give a shooter increased kinesthetic awareness of the trigger pull. The trigger can include any number of different kinesthetic features in different configurations such as ridges, grooves, bumps or depressions, raised or depressed surfaces, bars, etc. These features can provide an increased sense of feel to encourage the straight, even, efficient and/or consistent pressing of the weapon's trigger to produce consistent and accurate shot placement. The trigger can include two kinesthetic features or reference points, such as parallel bars, on the trigger face. With the parallel reference points the operator can apply equal pressure across the face of the trigger during manipulation.

18 Claims, 5 Drawing Sheets

(56) References Cited

U.S. PATENT DOCUMENTS

| | | | | |
|---|---|---|---|---|
| 6,651,642 | B1 * | 11/2003 | Powers | F41B 5/1469 124/31 |
| 7,073,284 | B2 | 7/2006 | Monks et al. | |
| 7,089,697 | B2 | 8/2006 | Monks | |
| D597,626 | S * | 8/2009 | Krieger | D22/108 |
| 7,854,084 | B1 | 12/2010 | Rutherford | |
| 7,992,338 | B2 * | 8/2011 | Bowman | F41A 19/10 42/90 |
| 8,036,704 | B2 | 10/2011 | Werner | |
| 8,099,895 | B2 | 1/2012 | Farley, Jr. et al. | |
| 8,220,193 | B1 * | 7/2012 | Lynch | F41A 17/48 42/70.08 |
| 8,234,969 | B2 | 8/2012 | Beckmann | |
| 8,250,799 | B2 * | 8/2012 | Duperry | F41A 19/10 42/42.02 |
| 8,539,707 | B1 * | 9/2013 | Di Trolio | F41A 15/16 42/25 |
| 8,572,878 | B2 * | 11/2013 | Gentilini | F41A 17/72 42/69.01 |
| 8,615,915 | B2 | 12/2013 | Hunter et al. | |
| 8,656,619 | B2 | 2/2014 | Popikov | |
| 8,881,442 | B2 | 11/2014 | Elftmann, Jr. | |
| 9,046,313 | B1 * | 6/2015 | Lutton | F41A 17/46 |
| 2003/0213159 | A1 * | 11/2003 | Cutini | F41A 17/46 42/70.06 |
| 2008/0115660 | A1 | 5/2008 | Hensel | |
| 2009/0158922 | A1 | 6/2009 | Werner | |
| 2010/0024273 | A1 * | 2/2010 | Duperry | F41A 19/16 42/69.01 |
| 2011/0079137 | A1 | 4/2011 | Audibert et al. | |
| 2011/0167691 | A1 * | 7/2011 | Bowman | F41A 19/10 42/1.01 |
| 2012/0117842 | A1 * | 5/2012 | Popikov | F41A 19/16 42/69.01 |
| 2013/0340309 | A1 * | 12/2013 | Lee | F41A 19/10 42/69.01 |
| 2014/0007763 | A1 | 1/2014 | Foster | |
| 2015/0153125 | A1 * | 6/2015 | Lutton | F41A 17/46 42/69.01 |
| 2015/0330734 | A1 * | 11/2015 | Kolev | F41A 3/12 42/69.01 |

OTHER PUBLICATIONS

Daiker, Duane A., Beretta Nano Micro 9MM Pocket Pistol—New Gun Review, Guns America, May 6, 2013, http://www.gunsamerica.com/blog/baretta-nano-micro-9mm-pocket-pistol-new-gun-review/.

Sagi, Guy, Ruger SR40 Gallery, Shooting Illustrated, Apr. 22, 2011, http://www.shootingillustrated.com/index.php/8563/ruger-sr40/.

* cited by examiner

TRIGGER

INCORPORATION BY REFERENCE TO ANY PRIORITY APPLICATIONS

This application claims priority to U.S. Provisional Appl. No. 62/105,167, filed Jan. 19, 2015. The entire contents of the above application(s) is/are hereby incorporated by reference and made a part of this specification. Any and all applications for which a foreign or domestic priority claim is identified in the Application Data Sheet as filed with the present application are hereby incorporated by reference under 37 CFR 1.57.

BACKGROUND OF THE INVENTION

Field of the Invention

Certain embodiments disclosed herein relate generally to triggers, and more specifically to triggers used for firing weapons, and weapons including such triggers.

Description of the Related Art

In order to achieve accurate shot placement with a weapon, the operator must ensure that the firing presentation of the weapon is not disturbed or altered during the operation of the trigger. Any movement from the sighted firing presentation can cause distraction in this alignment during trigger manipulation. This can, and usually does, result in a missed or deviated shot from intended placement. In order to achieve accuracy, the operator must ensure a straight, even and consistent press of the weapon's trigger during operation.

Traditional weapon's triggers typically have a smooth, flat surface providing only a single point of contact for the operator's finger. This single point of contact encourages tipping during the trigger press resulting in the weapon being pulled to either the left or the right. It is often difficult for the operator to sense this tipping during trigger manipulation. In addition, further loss of control and greater deviation occurs if the operator is wearing a medium, such as a "shooter's" or "tactical" glove.

In an attempt to remedy the above issues and increase the potential of a straight, even and consistent trigger press, shooters typically lighten the trigger pull, or weight required to operate the trigger. This is done to decrease the amount of pressure applied to the face of a given trigger, resulting in the operator being less likely to tip the weapon during trigger manipulation. At the same time, lightening the trigger pull weight from the manufacturer's intended specifications can result in a decrease in safety and reliability with the given weapon.

SUMMARY OF THE INVENTION

Accordingly, there is in the need of the art for improved triggers used for firing weapons, and weapons including such triggers, among other things.

Triggers with a smooth, flat surface that provide only a single point of contact for the operator's finger provide limited mechanoreceptor stimulation which results in limited kinesthetic awareness. This is why it is often difficult for the operator to sense tipping during trigger manipulation—because of the lack of kinesthetic feel against the face of the trigger. Wearing a glove further reduces the limited mechanoreceptor stimulation.

In some embodiments, an improved trigger can provide increased mechanoreceptor stimulation to give a shooter increased kinesthetic awareness of the trigger pull. The trigger can include any number of different kinesthetic features in different configurations such as ridges, grooves, bumps or depressions, raised or depressed surfaces, bars, etc. These features can provide an increased sense of feel to encourage the straight, even, efficient and/or consistent pressing of the weapon's trigger to produce consistent and accurate shot placement.

According to some embodiments, a trigger includes two kinesthetic features or reference points, such as parallel bars, on the trigger face. With the parallel reference points the operator is better able to feel the trigger and apply equal pressure across the face of the trigger during manipulation.

A trigger of some embodiments can include a prismatic body and an integrated set of stationary parallel bars. The prismatic body can include an elongated shape having a face with a curved surface. The integrated set of stationary parallel bars can rise a finite distance above the face of the prismatic body, such that the parallel bars are also curved. The parallel bars can run along at least a portion of the length of the curved surface of the face adjacent to or at the periphery of curved surface. The parallel bars can be set apart from one another by a space of a finite distance. The parallel bars can be approximately the same length along and approximately the same height above the curved surface. The parallel bars can be configured to be engaged by a digit of a user to pull the trigger providing two points of contact to increase mechanoreceptor stimulation in the digit.

In some embodiments, the prismatic body comprises a triangular prismatic body with a tapered end. A distal end opposite the tapered end of the body can include one or more apertures, whereby the one or more apertures are configured to pivotally mount the trigger within a weapon. The body may also include a void at the tapered end between the parallel bars.

According to some embodiments, a trigger can comprise a body having two parallel bars. Each of the parallel bar can have a curved outer edge configured to be engaged by a digit of a user to pull the trigger. The two parallel bars can be fixed in position with respect to each other so as to move in unison. In some embodiments, the parallel bars have an open space therebetween with between ⅛ inch to ½ inch between the parallel bars and a height of at least 0.25 inches to the curved outer edge to help ensure that the parallel bars are the only surface of the trigger that a user's digit will contact when pulling the trigger.

In some embodiments, a weapon can comprise a trigger with a triangular prismatic body having a substantially elongated curved shape tapering at one end and an integrated set of stationary parallel bars. The parallel bars can rise a finite distance above an upper surface of said triangular prismatic body. The bars can run along at least a portion of the length of the long axis of said body on substantially the periphery of said upper surface. The bars can be set apart from one another by a space of a finite distance, and have approximately the same length along and approximately the same height above said surface.

BRIEF DESCRIPTION OF THE DRAWINGS

Various embodiments are depicted in the accompanying drawings for illustrative purposes, and should in no way be interpreted as limiting the scope of the inventions, in which like reference characters denote corresponding features consistently throughout similar embodiments.

DETAILED DESCRIPTION

Figure 1:
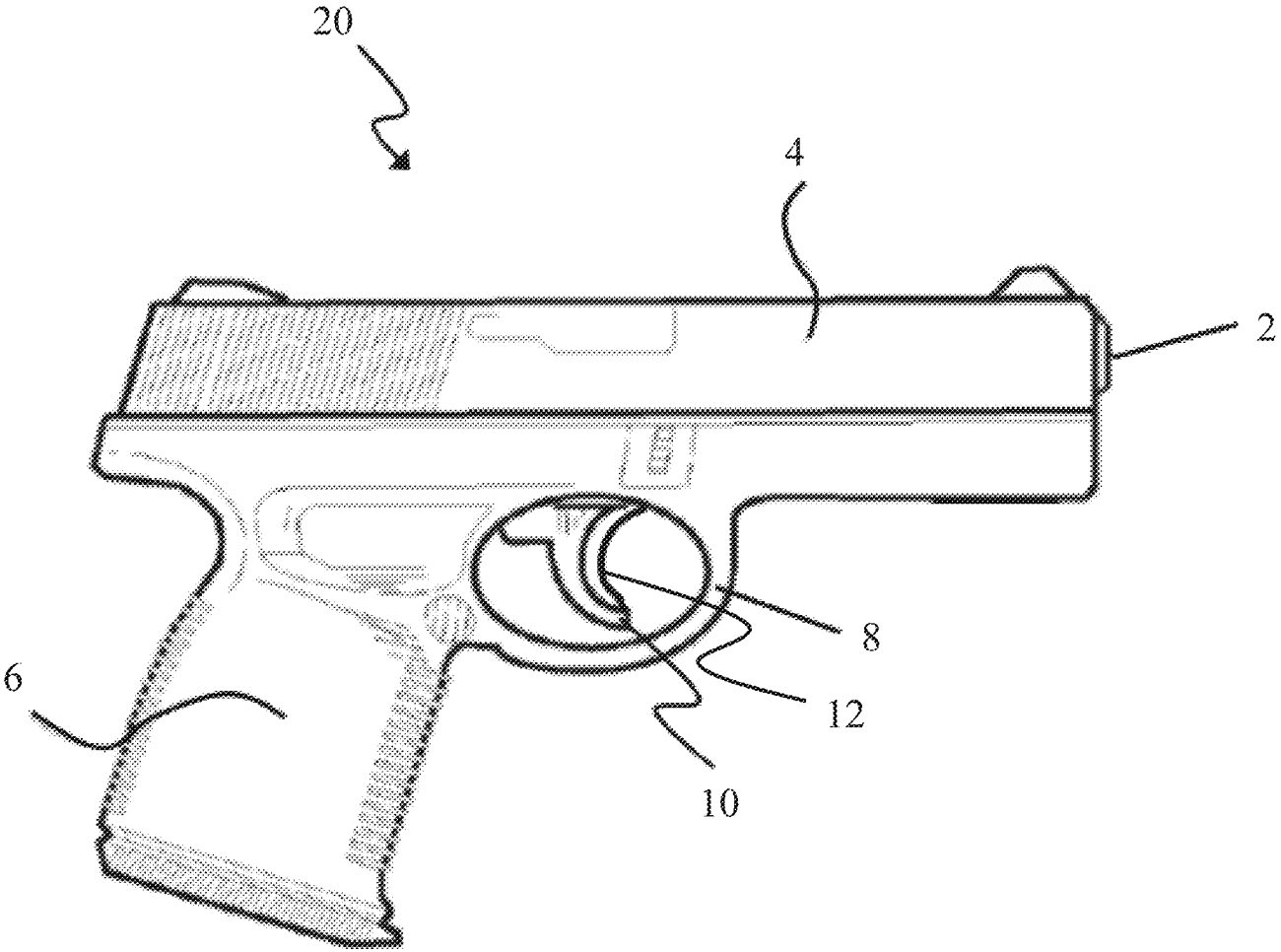
FIG. 1 shows a weapon.

Looking now to FIG. 1, a weapon 20, in the form of a handgun is shown. The weapon 20 has a barrel 2, a grip 6, and a trigger 10. The illustrated handgun also includes a slide 4 and a trigger guard 8. The weapon includes a trigger 10 having kinesthetic features 12 in the form of a pair of parallel bars, though other types of kinesthetic features could also be used as described herein. It will be understood that the principles described herein, in particular the improved trigger, can be used with any number of different systems. For example, the improved trigger can be used with any type of weapon with a trigger, such as handguns, rifles, shotguns, stun guns, railguns, crossbows, etc.

Figure 2:
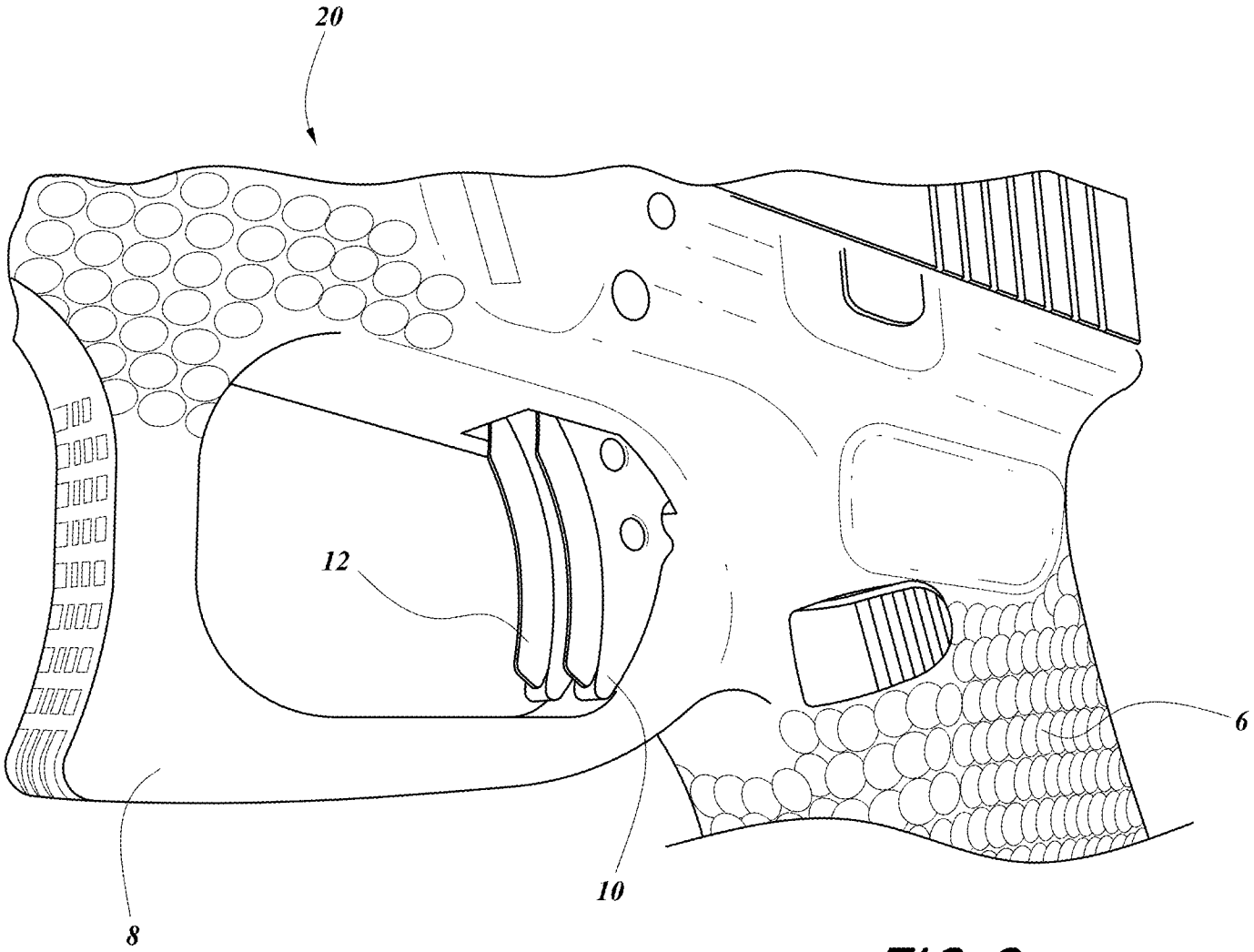
FIG. 2 is a perspective detail view of a trigger on a weapon.

A detail view of a trigger 10 mounted on a weapon 20 according to some embodiments is shown in FIG. 2. The trigger 10 includes a pair of kinesthetic features 12. The trigger 10 can provide increased mechanoreceptor stimulation to give a shooter increased kinesthetic awareness of the trigger pull. The trigger can include any number of different kinesthetic features 12 in different configurations, such as ridges, grooves, bumps or depressions, raised or depressed surfaces, bars, etc. These features can provide an increased sense of feel to encourage the straight, even, efficient and/or consistent pressing of the weapon's trigger to produce consistent and accurate shot placement.

In the illustrated embodiment, the trigger 10 includes parallel bars 12 on the trigger face. With the addition of parallel bars, or parallel reference points 12 on the trigger face, an operator is able to feel how pressure is being distributed across the face of the trigger during manipulation. The two raised points of contact or "parallel bars" allow the operator increased sensitivity in the pad of the trigger manipulation finger. This mechanoreceptor stimulation provides the operator additional information to help them evenly distribute mechanical pressure across the face of the trigger. This kinesthetic awareness and feedback is present while the operator's finger is applying rearward pressure to the face of the trigger. This can provide the operator with additional information to help produce a straight, even, and consistent press of the trigger. This can also help reduce pulling the weapon to one side during the trigger pull as pressure is not being applied unevenly to one side or the other of the trigger.

As will be understood, different weapons may employ triggers of different sizes and/or shapes. The face of the trigger—which is on the side of the trigger designed to be engaged by a digit of an operator—generally has some curvature to it, though the extent of the curvature can vary greatly. In addition, some triggers have a face that is predominately flat with little to no curvature. Among other movements, a trigger can be coupled to the weapon so as to pivot and/or slide with respect to the rest of the weapon when pulled. Kinesthetic features 12 can be provided on any of these different trigger designs. For example, the face of the trigger 10 illustrated in FIG. 1 has a different shape and curvature than the trigger 10 illustrated in FIG. 2, while still employing a pair of parallel kinesthetic features 12 (only one of which is visible in FIG. 1).

While there are systems which exist with triggers containing a plurality of grooves or ridges designed for gripping, the trigger surface remains substantially planar. Thus, no reference points can be distinguished on such a surface. As a result, no distinct points of contact can be resolved by pressing the operator's finger on the surface when using such systems. With the presence of the raised bars, the operator's finger pad would contact the parallel bars during trigger manipulation. Providing two points of contact beneficially serves as receptor stimulators and reference points for the operator.

Figure 3B:
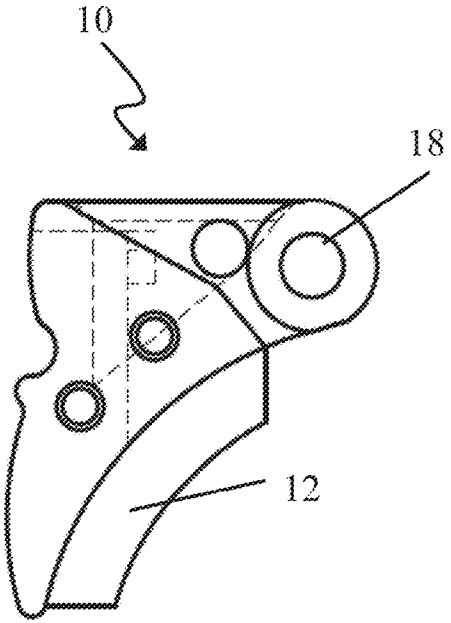
FIG. 3B is a side view of the trigger from FIG. 2.
Figure 3A:
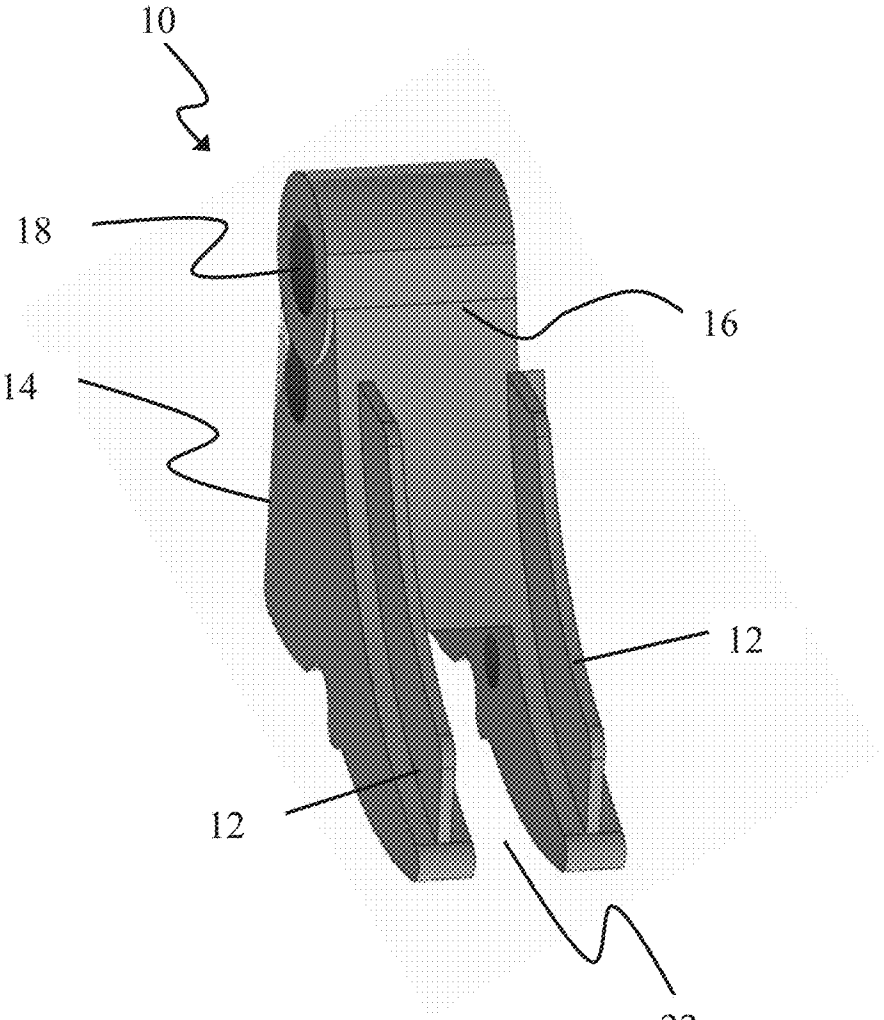
FIG. 3A shows a perspective view of the trigger from FIG. 2.

Looking now to FIGS. 3A-B, the trigger from FIG. 2 is shown separate from the weapon 20. The trigger 10 includes a body 14. As illustrated, the body 14 is a triangular prismatic body having a substantially elongated curved shape tapering at one end. An integrated set of stationary parallel bars 12 rise a finite distance from the face 16 of the triangular prismatic body 14. The bars 12 run along at least a portion of the length of the long axis of the body 14. The bars can be positioned on or adjacent to the periphery of the face 16 of the body 14. The bars 12 as illustrated are set apart from one another by a space of a finite distance. The parallel bars 12 are also the same length along and the same height above the face 16. In some embodiments, the outer surfaces of the bars 12 may have tapered edges, which edges may increase tactile sensitivity of the bars 12.

The trigger 10 can also include a hole 18, through which the trigger can be pivotally mounted to a weapon 20. In some embodiments, the body 14 has a void 22 in the face and between the parallel bars 12.

In some embodiments, the parallel bars 12 extend at least about 0.25 inches above the trigger face. This minimum height can help ensure that the parallel bars are the only surface of the trigger that a user's finger will contact. The space between the parallel bars 12 can be between about ⅛ of an inch to about ½ of an inch. Preferably, the parallel bars 12 are spaced apart about ¼ (0.25) to ⅜ (0.375) inch.

In some embodiments, the thickness of the bars 12 is between about 0.005 inches to about 0.125 inches. It has been found that bars with a thickness of about 0.025 inches or less provides good mechanoreceptor stimulation to a shooter with or without gloves.

As illustrated, trigger 10 the parallel bars are machined onto the face of the trigger. In such an embodiment, the trigger can be made of metal, such as aluminum or steel. The trigger can also be made of polymer. Other materials and methods of manufacture can be used. Further, the kinesthetic features 12 can be permanently or temporarily attached to the trigger. For example, the kinesthetic features 12 can be on a sleeve or snap on device.

With the addition of parallel bars, or parallel reference points on the trigger face, the operator is able to feel that equal pressure is being distributed across the face of the trigger during manipulation. The two raised points of contact or 'parallel bars' allow the operator increased sensitivity in the pad of the trigger manipulation finger. This mechanoreceptor stimulation provides the operator additional information to help them evenly distribute mechanical pressure across the face of the trigger. This kinesthetic awareness and feedback is present while the operator's finger is applying constant rearward pressure to the face of the trigger and provides the operator the necessary information to produce a straight, even, efficient and consistent press of the trigger.

Figure 4:
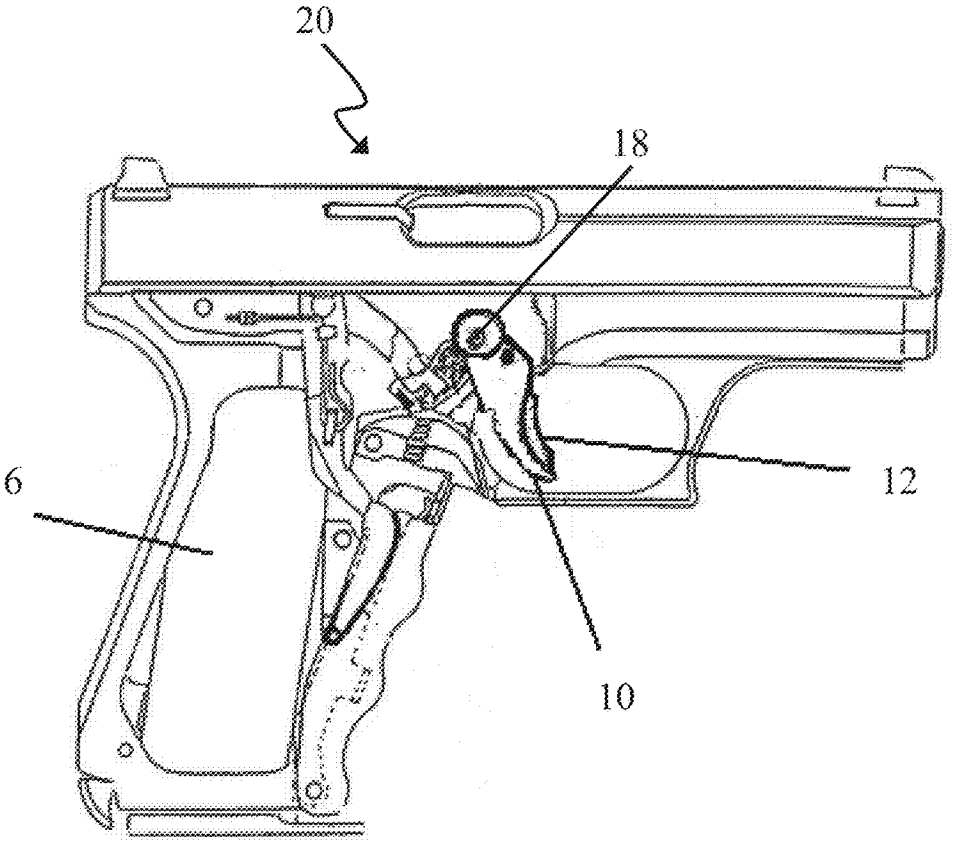
FIG. 4 shows a partial cross-section of a weapon employing the trigger of FIGS. 3A-B.

In FIG. 4, a system is illustrated showing the trigger 10 pivotally mounted on to a semi-automatic pistol 20 through hole 18. The pistol is shown in partial cross-section to show how the trigger 10 connects to the pistol. While the trigger 10 is shown with a pistol 20, the use of the trigger is not limited thereto, and one of skill in the art would recognize that the trigger 10 may be mounted on pistols, rifles, shotguns, machine guns and the like.

Figure 5:
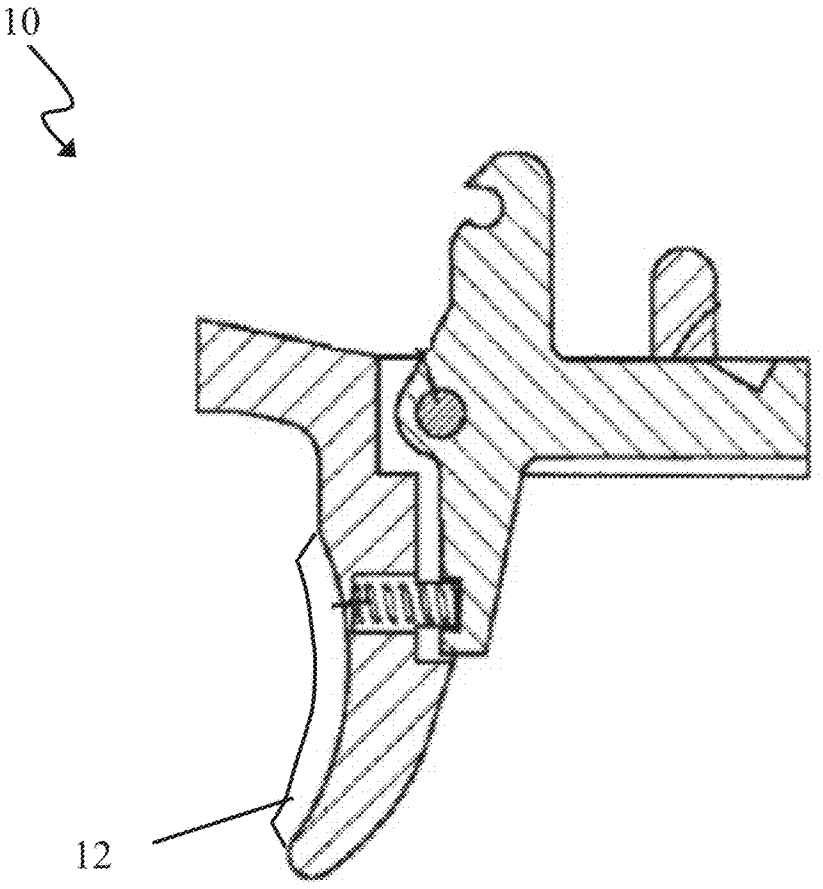
FIG. 5 is another embodiment of trigger in cross section.

FIG. 5 shows another embodiment of a trigger 10. The illustrated trigger 10 can be used in a rifle and is shown with bar 12. An identical bar 12 can be included on the portion of the trigger that is not shown. The bars 12 can be parallel as previously discussed. As shown, the trigger 10 of FIG. 5 is a multi-piece trigger.

The improved triggers discussed herein can provide many benefits. The parallel bar concept as disclosed may be applied to all triggers regardless of make, manufacture or design. The concept is universal, and may apply to any and all weapons in which the firing of the weapon is initiated with the rearward manipulation of a trigger. It will be understood that the trigger 10 can be an aftermarket trigger to replace a stock trigger, or it can be the stock trigger of a weapon.

In a related aspect, if the operator is wearing a medium, such as a "shooter's" or "tactical" glove, the decreased mechanoreceptor stimulation associated with covered digits of the operator may be overcome by the trigger 10 with kinesthetic features 12. This can help counteract the loss of control normally associated with using gloves which should result in smaller shot placement deviation.

The parallel bars as disclosed herein can allow the operator to sense whether he/she is applying pressure to one side of the trigger compared to the other side (i.e., uneven pull to the rear). By sensing even pressure on both bars, the operator is assured of achieving "straight to the rear" trigger-press, which translates into accurate shots on target. Further, the system allows for straight to the rear consistent presses without having to modify the mechanism to lighten the trigger pull weight.

In addition, for those operators using double action trigger pulls, consistency and vertical groupings on targets can become an issue. With the parallel bar trigger as disclosed herein, such issues are remedied without sacrificing targeting accuracy and precision.

In some embodiments, a method of vertical biasing shot placement from a weapon can include a number of steps. This can include placing a digit adjacent to the face of a trigger of a weapon, where the face comprises an integrated set of stationary parallel bars rising a finite distance above the face, and where the parallel bars are approximately the same length along and approximately the same height above the upper surface. Next, aiming the weapon at a target and pulling the trigger with the digit to release one or more projectiles from the weapon. The points of contact for the digit on the parallel bars increase the acute kinesthetic feedback from a rearward pull of the trigger. This can result in consistent vertical bias shot placement of projectiles from the weapon when compared to a weapon with a trigger having a smooth or planar contact surface. In addition, because the system as disclosed gives the operator a more acute feel of the trigger, even with gloved hands, the operator is afforded a safer experience (e.g., avoids negligent discharge).

In some embodiments, a trigger for a weapon is disclosed. The trigger can include a triangular prismatic body having a substantially elongated curved shape tapering at one end; and an integrated set of stationary parallel bars which rise a finite distance above an upper surface of said triangular prismatic body. The bars run along at least a portion of the length of the long axis of the body on substantially the periphery of the upper surface. The bars are set apart from one another by a space of a finite distance, and are approximately the same length along and approximately the same height above the surface.

In one aspect, at the tapered end of the body, the upper surface comprises a void between the parallel bars. In another aspect, a distal end opposite the tapered end of the body comprises one or more apertures, whereby the apertures are configured to engage the trigger with a firing mechanism of a weapon.

According to some embodiments, a weapon is disclosed which includes a trigger. The trigger can include a triangular prismatic body having a substantially elongated curved shape tapering at one end; and an integrated set of stationary parallel bars which rise a finite distance above an upper surface of the triangular prismatic body. The bars run along at least a portion of the length of the long axis of the body on substantially the periphery of the upper surface. The bars are set apart from one another by a space of a finite distance, and are approximately the same length along and approximately the same height above the surface.

Side-by-Side Comparisons

Comparisons were done between semi-automatic pistols, one with a stock trigger and the other with a parallel bar trigger 10. At least four shots were fired from each weapon, at a pace of 1 shot/0.25 seconds at a distance of about 7 yards. For the stock trigger results, groupings tended to be scattered and biased to left of center for the right handed shooter (no vertical tendency observed). For the parallel bar trigger, a vertical grouping of shots was observed. Moreover, the decrease in vertical deviation between the tests was about 50% (i.e., using the parallel bar trigger reduced deviation from center from about 2.5 inches to about 1.25 inches compared to a pistol containing a stock trigger).

Vertical Shot Placement

Biological principals in shooting relate to the stimulation of mechanoreceptors found within the skin and other surfaces of the body. Using the system 20 as disclosed, the operator immediately has a better feel for the trigger 10 because, as stated above, kinesthetic feedback would be similar to that of a pin (sharp surface) versus that of a planar surface (dull surface), where the sensory output from placement of a digit on the sharp surface would make the subject more acutely aware of any increase in pressure against said pin relative to the placement of the same digit on a dull or substantially planar surface. This allows for feeling the increasing or decreasing pressure of a trigger-press to the rear for more accuracy and precision in shooting.

Typically, a left-handed or right-handed shooter tends to bias shots to the opposite side of the shooting hand. For example, for a right-handed shooter, as fatigue sets in when shooting multiple shots, shots off target tend to bias to the left of center. Using the system 20 as disclosed herein, shots tend to amass in "tire track" or vertical track groupings. Further, even where firing speed is increased, vertical grouping is still observed. This biasing of rounds towards vertical helps increase accuracy.

Vertical Shot Placement with Media (Gloves)

In many instances, a shooter will use gloves to protect the hand. Unfortunately, under such circumstances, the shooter will become "kinesthetically blind." By having bars which are tactically distinct, even though the shooter's hand is covered by a medium (e.g., gloves), the edges of the bars allow the mechanoreceptors to be stimulated such that control and pressure sensitivity are maintained, translating, again into consistent shot performance. In addition, the gloves tend to dull the shooter's sense of the trigger and increase the shooter's tendency to pull the trigger too hard, which may result in negligent discharge.

Again, as was seen with uncovered hands, using the system 20 as disclosed herein, shots tended to amass in "tire track" or vertical track groupings. Further, because the parallel bars 102 allow for more acute feel of the trigger 10, the likelihood of negligent discharge is significantly reduced.

As used herein, "kinesthetic feedback" means sensory (i.e., tactile) return to the subject or operator of a part of the output from digit pressure on the surface of a trigger of a weapon. For example, the use of the trigger as disclosed for a subject shooter, kinesthetic feedback refers to the return of tactile information about the even rearward pull (or lack thereof) of a trigger, where for the trigger of the instant disclosure, kinesthetic feedback would be similar to that of a pin (sharp surface) versus that of a planar surface (dull surface), where the sensory output from placement of a digit on the sharp surface would make the subject more acutely aware of any increase in pressure against said pin relative to the placement of the same digit on a dull or substantially planar surface.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A trigger comprising:

a prismatic body having an elongated shape having a face with a curved surface; and an integrated pair of stationary parallel bars which rise a finite distance above the face of the prismatic body and are spaced apart from each other by a finite distance, the parallel bars having a curved shape and extending along at least a portion of the length of the curved surface of the face adjacent to or at the periphery of curved surface, the pair of parallel bars configured to prevent contact with a central portion of the face of the body that extends between the pair of parallel bars, wherein said parallel bars are approximately the same length along and approximately the same height above said curved surface, the parallel bars configured to be engaged by a digit of a user to pull the trigger providing two points of contact to increase mechanoreceptor stimulation in the digit.

2. The trigger of claim 1, wherein the prismatic body comprises a triangular prismatic body with a tapered end.

3. The trigger of claim 2, wherein a distal end opposite the tapered end of the body comprises one or more apertures, whereby the one or more apertures are configured to pivotally mount the trigger within a weapon.

4. The trigger of claim 2, wherein the body has a void at the tapered end between said parallel bars.

5. The trigger of claim 1, wherein the parallel bars are set apart from one another by a space of a finite distance of between ⅛ inch to ½ inch.

6. The trigger of claim 5, wherein the parallel bars rise a finite distance above the face of the prismatic body of at least 0.25 inches.

7. The trigger of claim 5, wherein the parallel bars are set apart from one another by a space of a finite distance of between ¼ and ⅜ inch.

8. The trigger of claim 7, wherein each of the parallel bars has a thickness of 0.025 inches or less.

9. The trigger of claim 5, wherein each of the parallel bars has a thickness of between 0.005 inches and 0.125 inches.

10. A trigger comprising:

a body having two parallel bars spaced from each other, each with a curved outer edge configured to be engaged by a digit of a user to pull the trigger, the two parallel bars fixed in position with respect to each other so as to move in unison;

wherein the parallel bars have an open space therebetween with between ⅛ inch to ½ inch between the parallel bars and having a height of at least 0.25 inches to the curved outer edge, the two parallel bars configured to define the only surface of the trigger that a user's digit will contact when pulling the trigger and configured to prevent contact with a portion of the trigger interposed between the two parallel bars.

11. The trigger of claim 10, wherein the parallel bars are spaced apart ¼ (0.25) to ⅜ (0.375) inch.

12. The trigger of claim 10, wherein each of the parallel bars has a thickness along a same axis as the space between the parallel bars of between 0.005 inches to 0.125 inches.

13. The trigger of claim 12, wherein the thickness is 0.025 inches.

14. The trigger of claim 12, wherein each of the parallel bars has a thickness along a same axis as the space of 0.025 inches.

15. The trigger of claim 10, wherein the body comprises a triangular prismatic body and the two parallel bars extend from the triangular prismatic body.

16. The trigger of claim 15, wherein the triangular prismatic body has a curved face from which the two parallel bars extend, being positioned at opposite sides of the triangular prismatic body.

17. The trigger of claim 10, wherein the portion of the trigger interposed between the two parallel bars includes a void that extends through the body of the trigger.

18. A weapon comprising a trigger with a triangular prismatic body having a substantially elongated curved shape tapering at one end; and an integrated pair of stationary parallel bars which rise a finite distance above an upper surface of said triangular prismatic body, which bars run along at least a portion of the length of the long axis of said body on substantially the periphery of said upper surface, wherein said pair of bars are set apart from one another by a space of a finite distance, and wherein said pair of parallel bars are approximately the same length along and approximately the same height above said surface, the pair of parallel bars configured to prevent contact with a central portion of the upper surface of the triangular prismatic body that extends between the pair of parallel bars.

* * * * *